US007405374B2

(12) United States Patent
Thomas et al.

(10) Patent No.: US 7,405,374 B2
(45) Date of Patent: Jul. 29, 2008

(54) DOOR PLUNGER SWITCH

(75) Inventors: Frederick Scot Thomas, Goodlettsville, TN (US); Timothy Paul Doyal, Goodlettsville, TN (US); James L. Ayres, Springfield, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 11/743,177

(22) Filed: May 2, 2007

(65) Prior Publication Data

US 2007/0278081 A1 Dec. 6, 2007

Related U.S. Application Data

(60) Provisional application No. 60/746,205, filed on May 2, 2006.

(51) Int. Cl.
*H01H 13/14* (2006.01)

(52) U.S. Cl. ..... 200/530; 200/16 D; 200/61.62; 200/61.76

(58) Field of Classification Search ..... 200/16 R–16 D, 200/61.62, 61.7, 61.73–61.76, 61.78, 61.81, 200/61.82, 520, 530, 534, 239, 242
See application file for complete search history.

(56) References Cited

U.S. PATENT DOCUMENTS 2,436,898 A * 3/1948 Rickmeyer ..... 200/530
2,605,375 A * 7/1952 Ellithorpe ..... 200/530
2,712,047 A * 6/1955 Herterick ..... 200/530
3,104,300 A * 9/1963 Hutt ..... 200/530
3,172,983 A * 3/1965 Zoda ..... 200/295
4,457,780 A * 7/1984 Osada et al. ..... 75/236
4,650,935 A * 3/1987 Ootsuka et al. ..... 200/16 A
4,806,711 A * 2/1989 Eckhaus ..... 200/61.62
5,023,413 A * 6/1991 Staples ..... 200/61.76
5,612,520 A * 3/1997 Toedtman et al. ..... 200/16 D
5,847,343 A * 12/1998 Kim ..... 200/61.76
6,207,910 B1 * 3/2001 Harvey et al. ..... 200/51.12
7,060,917 B1 * 6/2006 Park ..... 200/16 B

* cited by examiner

*Primary Examiner*—Michael A Friedhofer
(74) *Attorney, Agent, or Firm*—Pearne & Gordon LLP

(57) ABSTRACT

A plunger switch comprises a switch body housing a first contact element, a second contact element and an elongate plunger. The first contact element is partially housed in the switch body and extends out for operative communication with a circuit. The second contact element is movable along a longitudinal axis of the switch body and is aligned to contact the first contact element through movement. The elongate plunger is movable along the longitudinal axis of the switch body, and is able to be completely recessed in the switch body. Movement of the plunger in a first direction facilitates contact between the first and second contact elements. The contact elements contact at contact portions. At least a pair of the contact portions may have ridged surfaces that are oriented so as to have intersecting points at contact and configured to perform oxidation cleanup. At least a pair of the contact portions may include silver nitride.

22 Claims, 6 Drawing Sheets

DOOR PLUNGER SWITCH

CROSS-REFERENCE TO RELATED APPLICATIONS

This application claims the benefit of U.S. Provisional Application No. 60/746,205 filed May 2, 2006, the entire disclosure of which is hereby incorporated herein by reference.

FIELD OF THE INVENTION

The present invention relates to switches and, in particular, plunger switches for electrically indicating the position of a door.

BACKGROUND OF THE INVENTION

Plunger switches for indicating the position of a door are generally well known. For example, in home appliances such as ovens, a door is configured to press against a plunger when the door is shut and to release the plunger when the door is open while the plunger transmits each position through an electrical signal. One problem experienced by conventional plunger switches is that the plunger switch can break and become unusable if the door is slammed shut and the plunger strikes the bottom of the switch housing. Another problem is that, when the switch operates at low voltage and low amperage, oxidation cannot be burned off at the electrical contacts as well as at high voltage operation and the operation of the switch might be hindered by the oxidation and the position of the door can be incorrectly indicated. Thus, the switch must be equipped with features that can clean up the oxidation.

Therefore, there is a need for an improved plunger switch with features to guard against these problems.

SUMMARY OF THE INVENTION

Accordingly, it is an aspect of the present invention to obviate problems and shortcomings of conventional plunger switches.

In accordance with one aspect of the present invention, a plunger switch comprises a switch body housing a first contact element, a second contact element and an elongate plunger. The first contact element is partially housed in the switch body and extends out for operative communication with a circuit. The second contact element is movable along a longitudinal axis of the switch body and is aligned to contact the first contact element through movement. The elongate plunger is movable along the longitudinal axis of the switch body, and is able to be completely recessed in the switch body. Movement of the plunger in a first direction facilitates contact between the first and second contact elements.

In accordance with another aspect of the invention, the plunger is moved by opening and shutting a door.

In accordance with yet another aspect of the present invention, the door is part of a home appliance.

In accordance with yet another aspect of the present invention, the switch body is substantially cylindrical, and has a first base and a second base.

In accordance with yet another aspect of the present invention, a first biasing element is configured to bias the plunger in a second direction, opposite the first direction, and a second biasing element is configured to bias the plunger in the first direction.

In accordance with yet another aspect of the present invention, the first biasing element is placed between the plunger and the first base, and the second biasing element is placed between the second contact element and the second base.

In accordance with yet another aspect of the present invention, an end portion of the plunger does not contact the switch body when completely recessed within the switch body.

In accordance with yet another aspect of the present invention, the plunger includes an engaging portion that is able to engage the second contact element in a second direction, opposite the first direction, so that the second contact element and the plunger move together. The plunger is movable with respect to the second contact element when the engaging portion does not engage the second contact element.

In accordance with yet another aspect of the present invention, the engaging portion is a shoulder radially projecting from the plunger.

In accordance with yet another aspect of the present invention, the first contact element is a pair of parallel pins forming a plug.

In accordance with yet another aspect of the present invention, the second contact element is substantially annular.

In accordance with yet another aspect of the present invention, the second contact element and the plunger have radial projections, and the switch body has inner longitudinal grooves in which the radial projections can slidingly travel.

In accordance with yet another aspect of the present invention, the first and second contact element contact at contacting parts having ridged surfaces that are oriented so as to have intersecting points at contact.

In accordance with yet another aspect of the present invention, the ridged surfaces are configured to perform oxidation cleanup.

In accordance with yet another aspect of the present invention, a removable cap forms the first base of the plunger switch, and the switch body has an imprint in which a retention clip can snappingly fit and secure the cap in place.

In accordance with yet another aspect of the present invention, the retention clip is configured to resiliently secure the plunger switch inside a cavity of a home appliance.

In accordance with yet another aspect of the present invention, the retention clip has a serrated surface for securing the plunger switch inside the cavity.

In accordance with yet another aspect of the present invention, a plunger switch comprises a switch body having a first base and a second base and defining a longitudinal axis with a first direction and a second direction, the first direction being from the second base to the first base, the second base having an opening. The switch body houses a first contact element, a second contact element, an elongate plunger, a first biasing element and a second biasing element. The first contact element is partially housed in the switch body and extends out for operative communication with a circuit. The first contact element is immovable about the switch body and includes a first contact portion. The second contact element is movable along the axis and is aligned to contact the first contact element through movement. The second contact element includes a second contact portion. An elongate plunger includes an engaging portion and is movable out of the opening along the axis. The engaging portion is able to engage the second contact element in the second direction so that the second contact element and the plunger move together. The plunger is movable in the first direction with respect to the second contact element when the engaging portion does not engage the second contact element. The first biasing element is configured to bias the plunger in the second direction. The second biasing element is configured to bias the second contact element in the first direction. The first and second contact elements do not contact in a default first operative position.

The first and second contact elements contact in a second operative position, and movement of the plunger in the first direction allows the second operative position to be reached. The first and second contact portions have ridged surfaces that are aligned so as to not mate.

In accordance with yet another aspect of the present invention, a plunger switch comprises a switch body having a first base and a second base and defining a longitudinal axis with a first direction and a second direction. The first direction is from the second base to the first base, and the second base has an opening. The switch body houses a first contact element, a second contact element, an elongate plunger, a first biasing element, and a second biasing element. The first contact element is partially housed in the switch body and extends out for operative communication with a circuit. The first contact element is immovable about the switch body and includes a first contact portion. A second contact element is movable along the axis and is aligned to contact the first contact portion through movement. The second contact element includes a second contact portion. An elongate plunger includes an engaging portion and is movable out of the opening along the axis. The engaging portion is able to engage the second contact element in the second direction so that the second contact element and the plunger move together. The plunger is movable in the first direction with respect to the second contact element when the engaging portion does not engage the second contact element. The first biasing element is configured to bias the plunger in the second direction. The second biasing element is configured to bias the second contact element in the first direction. The first and second contact elements do not contact in a default first operative position. The first and second contact elements contact in a second operative position. Movement of the plunger in the first direction allows the second operative position to be reached. The first and second contact portions include silver nitride.

In accordance with yet another aspect of the present invention, a plunger switch comprises a switch body having a first base and a second base and defining a longitudinal axis with a first direction and a second direction. The first direction is from the second base to the first base, and the second base has an opening. The switch body houses a first contact element, a second contact element, a third contact element, a fourth contact element, an elongate plunger, a first biasing element, and a second biasing element. The first contact element is partially housed in the switch body and extends out for operative communication with a circuit. The first contact element is immovable about the switch body. The second contact element is partially housed in the switch body and extends out for operative communication with the circuit. The second contact element is immovable about the switch body. The third contact element is movable along the axis and aligned to contact the first contact element through movement. The fourth contact element is movable along the axis and is aligned to contact the second contact element through movement. An elongate plunger includes an engaging portion, is movable out of the opening along the axis, and is able to be completely recessed in the switch body. The engaging portion is able to engage the third contact element in the second direction so that the third contact element and the plunger move together. The plunger is movable in the first direction with respect to the third contact element when the engaging portion does not engage the third contact element. The plunger moves with the fourth contact element in the both directions. The first biasing element is configured to bias the plunger and the fourth contact element in the second direction. The second biasing element is configured to bias the third contact element in the first direction. The second and fourth contact elements contact in a default first operative position. The first and third contact elements contact in a second operative position. Movement of the plunger in the first direction allows the second operative position to be reached.

In accordance with yet another aspect of the present invention, the contact elements contact at contact portions, and at least a pair of the contact portions has ridged surfaces that are oriented so as to have intersecting points at contact.

In accordance with yet another aspect of the present invention, the contact elements contact at contact portions, and at least a pair of the contact portions includes silver nitride.

In accordance with yet another aspect of the present invention, the engaging portion is located on the plunger so as to keep the third and fourth contact elements a minimum distance apart making the first and second operative positions asynchronous.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1B:
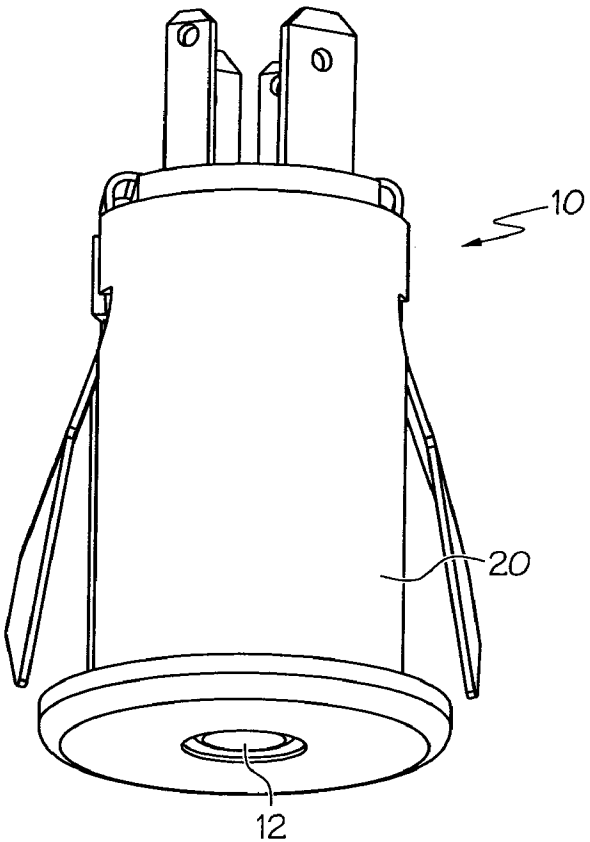
FIG. 1B is a view of the plunger switch with the plunger in a recessed state.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

Figure 1A:
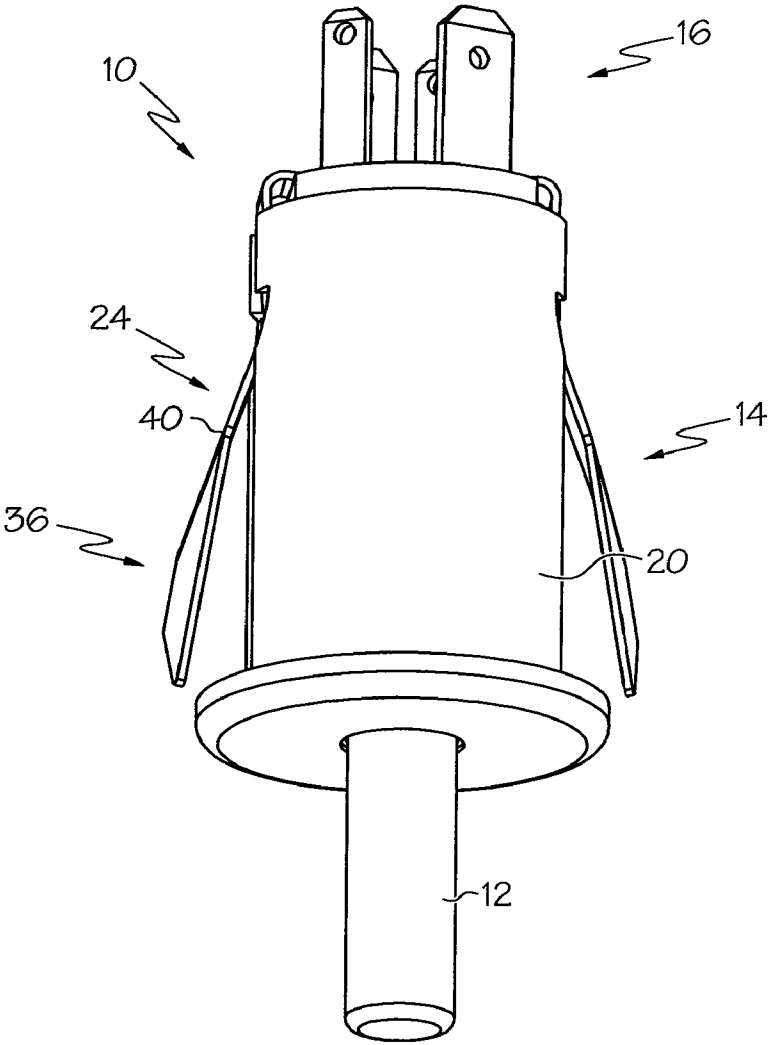
FIG. 1A is a view of a plunger switch of the present invention with a plunger in a non-recessed state.

FIG. 1A shows a first embodiment of a plunger switch 10. This embodiment of the plunger switch 10 mainly comprises a plunger 12, a switch body 14 and a plug portion 16. The plunger switch 10 is installed on a home appliance, such as an oven, microwave, dishwasher, dryer or washing machine, so that it can electrically indicate the position of a moving part, such as a door, that is relayed to the plunger 12. Accordingly, the plunger switch 10 is mounted so that the switch body 14 and the plug portion 16 are substantially enclosed within the appliance and only the plunger or a part of the plunger 12 is exposed. In this embodiment, a closed position of the door pushes the plunger 12 into the switch body 14 (FIG. 1B) while an open position of the door releases the plunger 12. It is to be appreciated that the plunger 12 can be entirely recessed or only partially recessed depending upon how the switch 10 is mounted in the appliance. The plug portion 16 of the switch 10 is operatively coupled to an electrical circuit of the appliance and is in operative communication so that the circuit can detect the different positions of the plunger 12 and the door.

Figure 2:
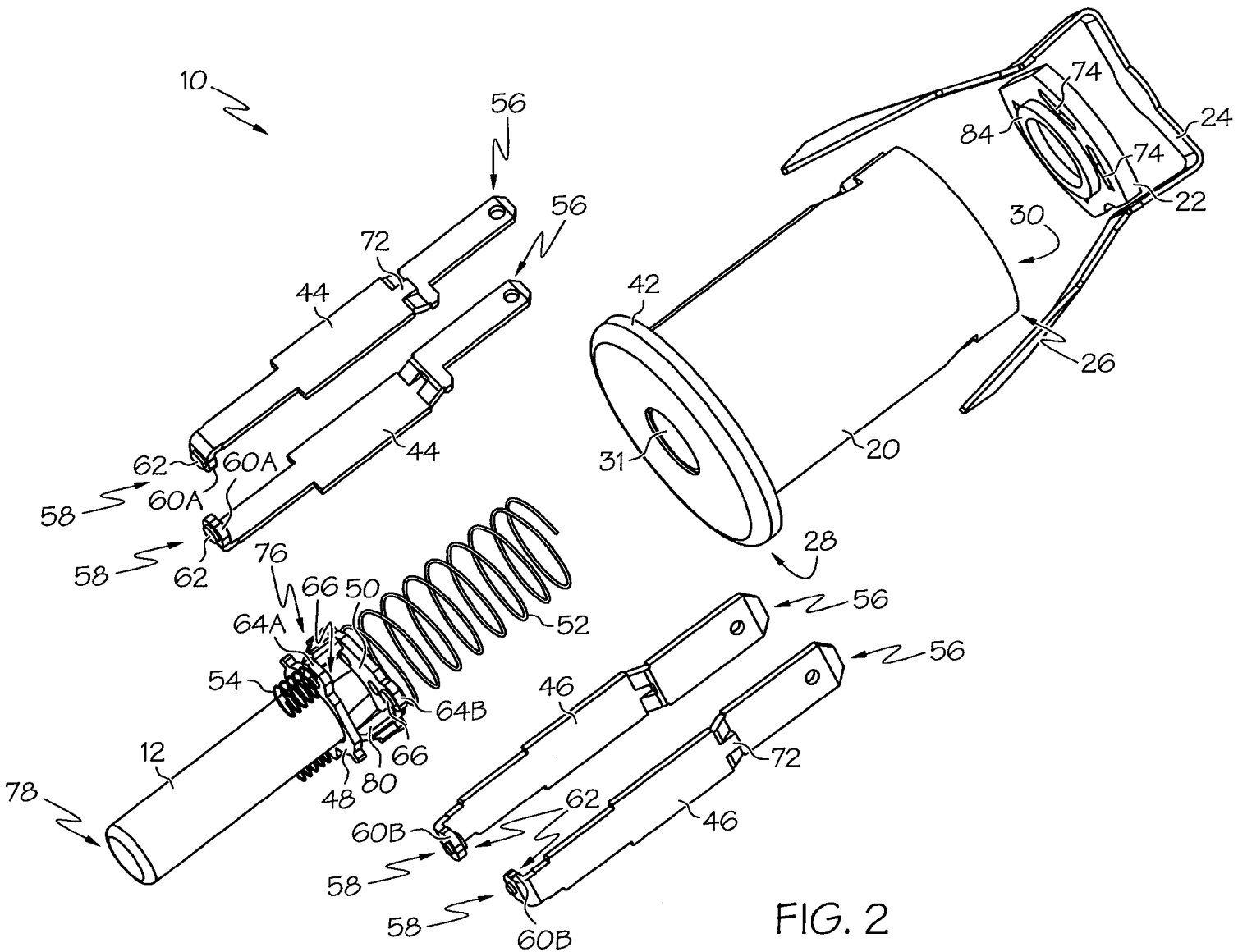
FIG. 2 is an exploded view of the plunger switch.

FIG. 2 shows an exploded view of the first embodiment of the plunger switch 10. The exterior of the plunger switch 10 comprises a switch housing 20, a removable cap 22 and a retention clip 24. The switch housing 20 is a substantially cylindrical in shape and has a first base 26 and a second base 28. The switch housing 20 can have shapes other than cylinders. In case the switch 10 is embodied in a cylinder, the bases 26, 28 of the cylinder may be polygonal although they are circular in FIG. 1A. The first base 26 provides a first opening 30 through which the inner components of the plunger switch 10 can be inserted and the first opening 30 is closed with the removable cap 22 and the retention clip 24. In this embodiment, the retention clip 24 is a resilient element that is placed over the cap 22 to hold it in place. As shown in FIGS. 2 and 5A, this fastening mechanism can be achieved by one or more teeth 32 on the retention clip 24 and by correspondingly shaped imprints 34 on the exterior of the switch housing 20 in which the teeth 32 can snappingly fit as the retention clip 24 is pressed against the cap 22. The retention clip 24 is substantially U-shaped but is configured so that its limbs 36 point outwardly at an angle after the retention clip 24 is placed over the cap as shown in FIG. 1. Moreover, such configuration of the limbs 36 resiliently holds the plunger switch 10 in position inside a cavity of the appliance. Ridges 38 at the ends of the limbs 36 further contribute to the securing of the plunger switch 10 by allowing a metal sheet (not shown) in the cavity to bite into the ridges 38. After the plunger switch 10 is placed in the cavity, the limbs 36 are elastically deformed into longitudinal grooves 39 on the sides of the switch housing 20. The resiliency of the limbs 36 is adjusted by an additional bent 40 at a mid portion as shown in FIG. 1. Instead of the resilient retention clip 24, the plunger switch 10 can be secured in the appliance through any other suitable means such as glue or screws and the removable cap 22 can likewise be held in place via suitable means.

As shown in FIG. 1, the second base 28 of the plunger switch 10 has a second opening 31 for the plunger 12 to pass through. A flange 42 at the second base 28 prevents the switch body 14 from being further pushed into the cavity and damaging a socket structure (not shown) in the appliance to which the plug portion 16 is connected.

Figure 3A:
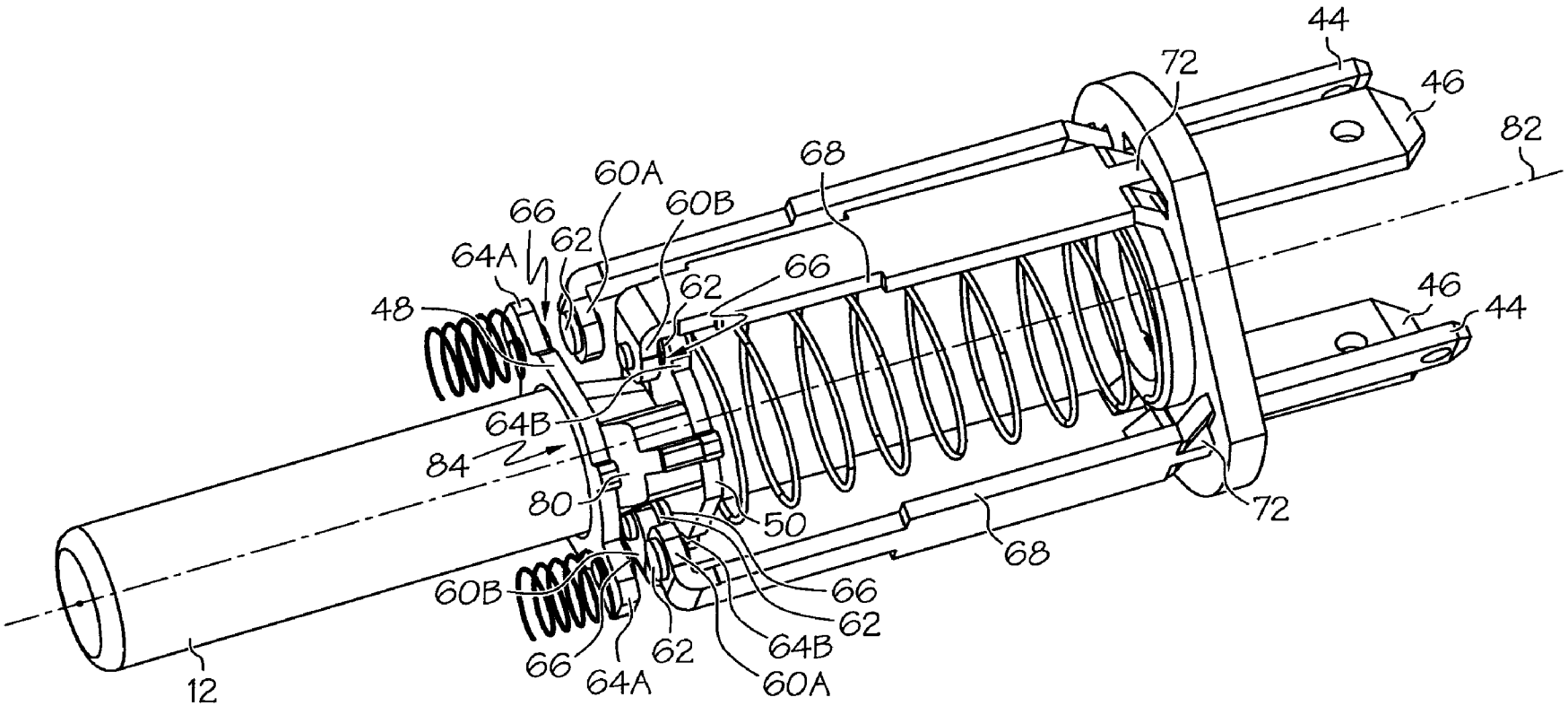
FIG. 3A is a view of the plunger switch in the non-recessed state shown without a switch housing.
Figure 3B:
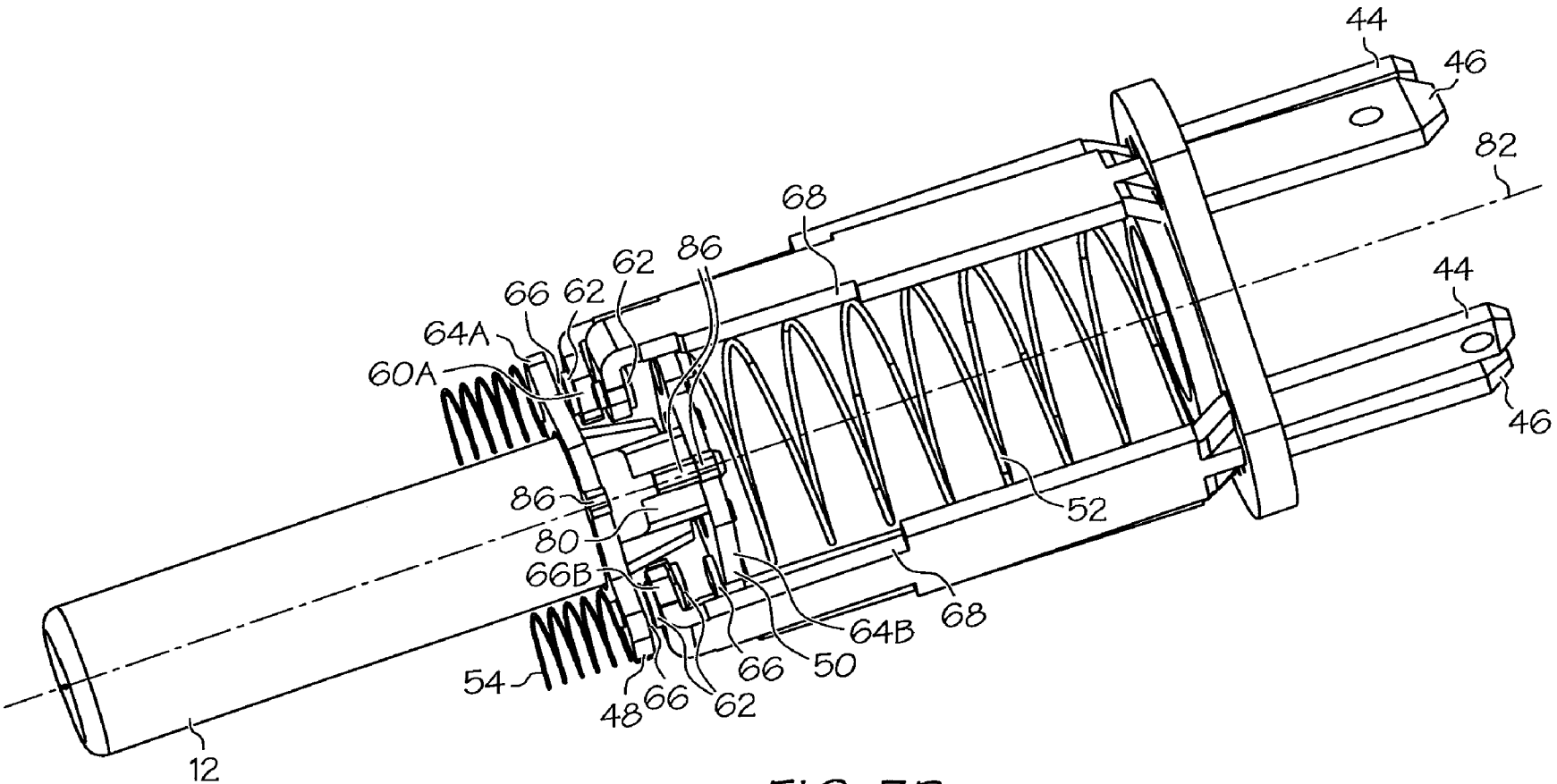
FIG. 3B is a view of the plunger switch in a partially recessed state shown without the switch housing.

In the embodiment shown in FIG. 2, the interior of the plunger switch 10 comprises a first pair of parallel pins 44, a second pair of parallel pins 46, the plunger 12, a first contact element 48, a second contact element 50, a first biasing element 52 and second biasing elements 54. Each pin is a substantially elongate component with a first end 56 that is shaped like a prong of a plug inserted in a socket. A second end 58 of each pin has a bracket-shaped contact member 60A (or 60B) that includes a disk-shaped contact plate 62. The first contact element 48 and the second contact element 50 also have contact members 64A, 64B with the disk-shaped contact plates 66. In FIGS. 3A and 3B, which show the plunger switch 10 without the switch housing 20, the first pair of pins 44 is aligned so that its contact members 60A can contact the contact members 64A of the first contact element 48 while the second pair of pins 46 is aligned so that its contact members 60B can contact the contact members 64B of the second contact element 50. Furthermore, the contact members 62 of the first pair of pins 44 are located on the side of the contact member 60A facing the first contact element 48 so that they can abut against the contact plates 66 of the first contact element 48. The contact plates 62 of the second pair of pins 46 are located on the side of the contact member 64B facing the second contact element 50 so that they can abut against the contact plates 66 of the second contact element 50.

In FIGS. 3A and 3B, the edges 68 of the pins 44, 46 are configured so as to mate with correspondingly shaped slots inside the switch housing 20. Accordingly, once the pins 44, 46 are inserted into the slots through the first opening 30, they descend to a predetermined level inside the switch housing 20 and become partially housed in the switch housing 20 with the first ends 56 protruding out. The first pair of pins 44 and the second pair of pins 46 may differ in the shape of their edges 68 but the primary difference between the two pairs 44, 46 has to do with the location of the contact plates 62 as discussed above. The pins 44, 46 are further configured to include support features 72 to engage the cap 22. The cap 22 has apertures 74 to let the pins 44, 46 through and secure them with respect to the switch housing 20.

As shown in FIGS. 2, 3A and 3B, the plunger 12 is an elongate element with a first end 76 and a second end 78 and has a shoulder 80 that projects radially near the first end 76. The plunger 12 and the first and second contact elements 48, 50 are able to move along a longitudinal axis 82 (FIGS. 3A and 3B) defined by the cylindrical switch housing 20. The first contact element 48 has an aperture 84 that the plunger 12 can freely move through until the shoulder 80 engages the first contact element 48 while traveling toward the second base 28 of the switch housing 20. In this embodiment, the first biasing element 52 is a large spring that is pressed between the cap 22 and the second contact element 50 so that the second contact element 50 abuts against the first end 76 of the plunger 12. The cap 22 has an annular projection 84 into the switch housing 20 for holding one end of the large spring in place. In this embodiment, the second biasing elements 54 are two small springs that are located radially opposite one another for balance and are pressed between the first contact element 48 and the second base 28 of the switch housing 20. The interior of the switch housing 20 can include molded receptacles 85 (not shown) to help keep the second biasing elements 54 aligned and in place. Moreover, the first contact element 48, the shoulder 80 and the second contact element 50 include radial projections 86 (FIG. 3B) that slidingly travel inner channels 87 (not shown) extending longitudinally in the switch housing 20 in order to keep these three components aligned as they move along the axis 82 and to maintain the alignment of the contact elements 48, 50 with respect to the pins 44, 46. The biasing elements 52, 54 are configured to be kept in tension inside the switch housing 20 so that two forces acting in opposite directions may move the contact elements 48, 50 in response to the movement of the plunger 12. Other types of biasing elements may also be used instead of the coil springs used in this embodiment.

FIG. 3A shows a first operative position of the plunger 12. The first operative position is a default position of the plunger 12 and is achieved because the first biasing element 52 is configured to exert a force stronger than the combined force of the second biasing elements 54. In the first operative position, the second contact element 50 is pushed by the first biasing element 52 away from the first base 26 until the contact plates 66 of the second contact element 50 abut against the contact plates 62 of the second pair of pins 46. The second contact element 50 consequently pushes the plunger 12 and the first contact element 48 away from the first base 26. In the first operative position, the contact plates 66 of the first contact element 48 do not abut against the contact plates 62 of the first pair of pins 44 because the shoulder 80 of plunger 12 is configured to keep the first and second contact elements 48, 50 at least a minimum distance apart. Thus, a maximum of one contact between a contact element and a pair of pins is possible at any given time.

FIG. 3B shows a second operative position of the plunger 12. The second operative position is achieved when the plunger 12 is moved toward the first base 26 by an external force such as the closing of a door in opposition to the first biasing element 52. If the plunger 12 travels a sufficient distance toward the first base 26, this will enable the contact plates 66 of the first contact element 48 to abut against the contact plates 62 of the first pair of pins 44 due to the force from the second biasing element 54. Although not shown, it is possible for the plunger 12 to travel a sufficient distance toward the first base 26 so that the shoulder 80 is not in contact with the first contact element 48. Moreover, it is possible to dimension the plunger 12 so that it can be completely recessed within the switch housing 20 as shown in FIG. 1B. If the switch housing 20 is configured to be sufficiently longer than the plunger 12, even a plunger 12 that travels too far into the switch housing 20, such as due to a slamming door, will not strike the first base 26 of the switch housing 20 and cause breakage.

As the door is opened from a closed position, the first biasing element 52 will push the second contact element 50 and the plunger 12 toward the second base 28 so that the plunger 12, that was able to move with respect to the first contact element 48, eventually engages the first contact element 48 through the shoulder 80 and moves the first contact element 48 toward the second base 28. Accordingly, the plunger 12 will shift from the second operative position shift back to the first operative position.

The plunger switch 10 is in operative communication with a circuit through the first ends 56 of the pins 44, 46 that extend out of the switch housing 20 and the circuit can detect the position of a moving part, such as a door, based on which pair of pins and contact elements touch one another. Accordingly, the pins 44, 46 and the contact elements 48, 50 act as elements for allowing the plunger switch 10 to operatively communicate with the circuit.

Figure 4A:
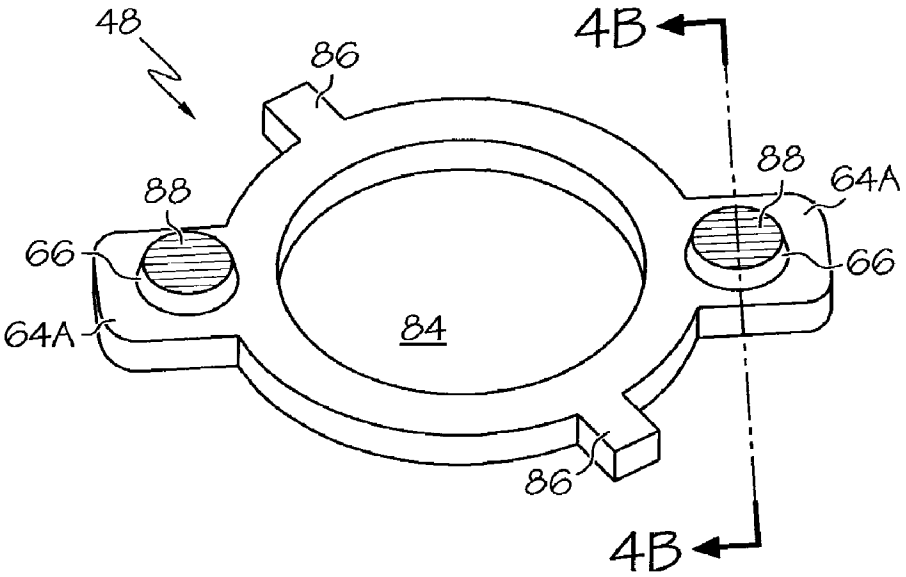
FIG. 4A is perspective view of a first contact element of the plunger switch.
Figure 4C:
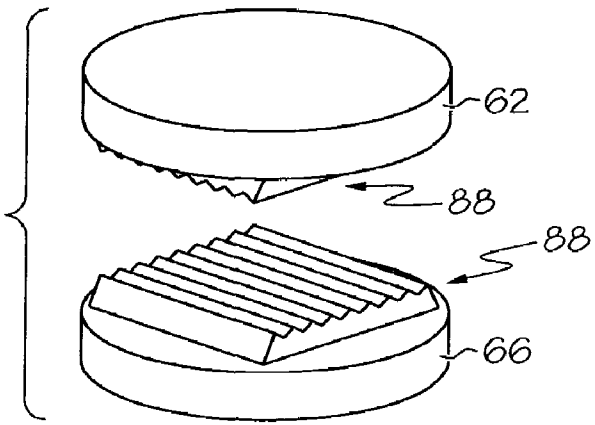
FIG. 4C is perspective view of the two oppositely facing contact plates.
Figure 4B:
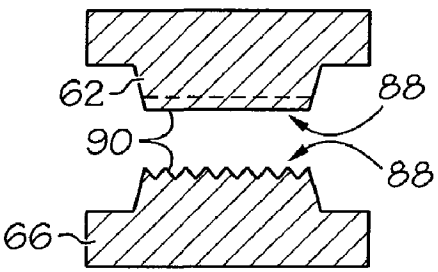
FIG. 4B is a cross-sectional view of two oppositely facing contact plates.

FIG. 4A shows the first contact element 48 of the plunger switch 10. The first contact element 48 in this embodiment is substantially annular in shape with the contact members 64A projecting radially from the element 48. The second contact element 50 may be shaped similarly as the first contact element 48 except for the aperture 84. The disk-like contact plates 66 of the contact elements 48, 50 and the contact plates 62 of the pins 44, 46 may have ridged surfaces 88, as shown in FIGS. 4B-4C, and the ridges 90 of two oppositely facing contact plates 62, 66 may be oriented so that they will have a number of intersecting contact points. In this embodiment, the oppositely facing ridged surfaces 88 are oriented so that a ridge 90 is a substantially orthogonal about an oppositely facing ridge 90. Such an orientation enables the ridges 90 to clean up the contact plates 62, 66 by plowing through possible oxidation buildup between the contact plates 62, 66 when the contact plates 62, 66 are pressed against one another thereby establishing contact through a number of intersecting points in spite of the oxidation layer. Certain orientations, such as one where a ridged surface 88 fittingly mates with an oppositely facing ridged surface 88, may not clean up oxidation as effectively. A person of ordinary skill in the art will appreciate that the self-cleaning of oxidation can be achieved through various orientations of oppositely facing ridges 90.

The contact plates 62, 66 can be configured to be integral parts of the contact elements 48, 50 or separate elements that are fastened to the contact elements 48, 50. Furthermore, the contact plates 62, 66 can be made of copper, silver nitride, gold or any material able to conduct electricity. For an appliance that operates at low voltage and is less capable of burning off oxidation, such as the present embodiment, the contact plates 62, 66 made of silver nitride are used for better resistance to oxidation.

Figure 5B:
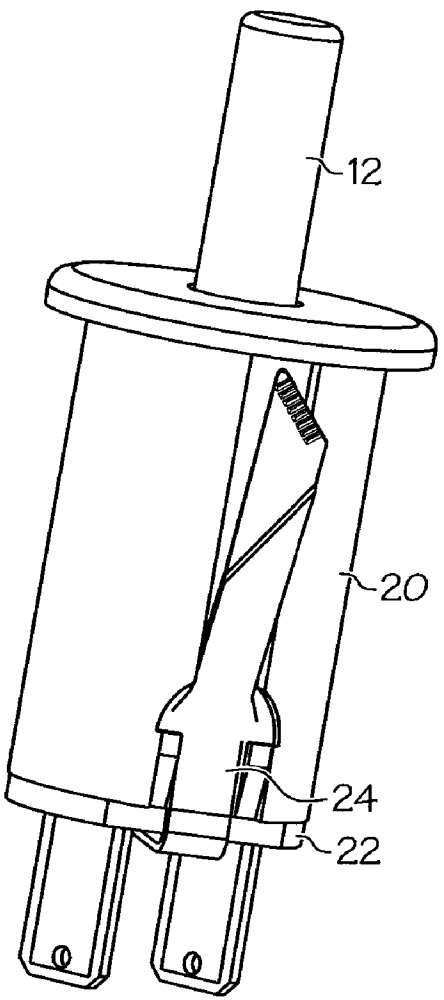
FIG. 5B is a view of a second embodiment of the plunger switch.
Figure 5A:
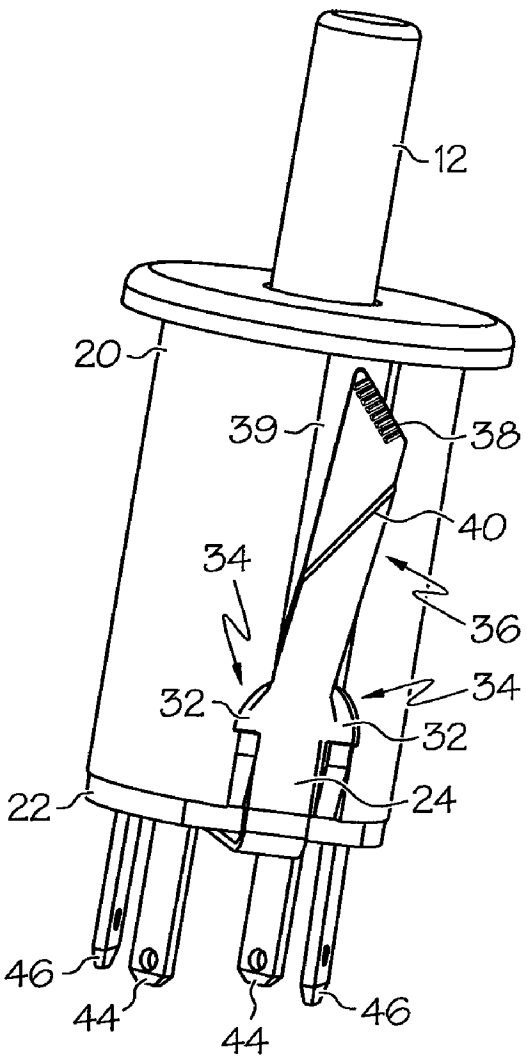
FIG. 5A is a view of a first embodiment of the plunger switch.

FIG. 5B shows a different embodiment of the plunger switch 10 that only has the first pair of pins 44. This embodiment differs from the previous embodiment in that the second pair of pins 46 is missing. Accordingly, in the first operative position, the first biasing element 52 will push the second contact element 50 and the plunger 12 as far away from the first base 26 as possible without being caught by the contact members 60B of the second pair of pins 46. The second operative position is reached in the same manner as the previous amendment. This embodiment will indicate the state of a moving part based on whether or not the contact is established between the first contact element 48 and the first pair of pins 44.

Assembly of the plunger switch 10 for the embodiments described herein is accomplished as described in the following. The second biasing elements 54 are inserted through the first opening 30 into the receptacles 85 within the switch housing 20. The first contact element 48 is inserted so that the radial projections 86 slidingly travel down the inner channels 87 with the contact plates 66 facing the first base 26 until the contact members 64A of the first contact element 48 rest on the biasing elements 54. The plunger 12 is then inserted so that its radial projections 86 slidingly travel down the inner channels 87 until the shoulder 80 rests on the first contact element 48. Thereafter, the first pair and the second pair of pins 44, 46 are inserted into their respective slots of the switch housing 20 so that the contact members 60A, 60B drop to a level adjacent to the shoulder 80 and above the first contact element 48 and keeping in mind that the contact plates 62 of the first pair of pins 44 and the contact plates 66 of the first contact element 48 must be aligned. The second contact element 50 is then inserted with the contact plates 66 facing the second base 28 so that the radial projections 86 slidingly travel down the inner channels 87 until the second contact element 50 rests against the plunger 12 and keeping in mind that the contact plates 62 of the second pair of pins 46 and the contact plates 66 of the second contact element 50 must be aligned. If the radial projections 86 are provided on the first and second contact elements 48, 50 and the plunger 12, and the inner channels 87 are correspondingly provided on the switch housing 20, the alignment will occur as long as the contact elements 48, 50 are inserted facing the proper direction. After the first biasing element 52 is inserted into the switch housing 20, the removable cap 22 is placed over the first opening 26 so that the pins 44, 46 pass through the apertures 74 of the cap 22 and the first biasing element 52 rests against the annular projection 84. Thereafter, while holding the cap 22, the retention clip 24 is pressed against the cap 22 until the teeth 32 of the retention 24 clip snappingly fit into the imprints 34 on the switch housing 20.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed:

1. A plunger switch comprising:

a switch body housing:

a first contact element partially housed in the switch body and extending out for operative communication with a circuit;

a second contact element being movable along a longitudinal axis of the switch body and aligned to contact the first contact element through the longitudinal movement; and an elongate plunger movable along the longitudinal axis of the switch body, and able to be completely recessed in the switch body, wherein the longitudinal movement of the plunger in a first direction facilitates contact between the first and second contact elements, and wherein the first and second contact element contact at contacting parts having ridged surfaces that are oriented so as to have intersecting points at contact.

2. The plunger switch of claim 1, wherein the plunger is moved by opening and shutting a door.

3. The plunger switch of claim 2, wherein the door is part of a home appliance.

4. The plunger switch of claim 1, wherein the switch body is substantially cylindrical, and has a first base and a second base.

5. The plunger switch of claim 4, wherein a first biasing element is configured to bias the plunger in a second direction, opposite the first direction, and a second biasing element is configured to bias the plunger in the first direction.

6. The plunger switch of claim 5, wherein the first biasing element is placed between the plunger and the first base, and the second biasing element is placed between the second contact element and the second base.

7. The plunger switch of claim 4, wherein a removable cap forms the first base of the plunger switch, and the switch body has an imprint in which a retention clip can snappingly fit and secure the cap in place.

8. The plunger switch of claim 7, wherein the retention clip is configured to resiliently secure the plunger switch inside a cavity of a home appliance.

9. The plunger switch of claim 8, wherein the retention clip has a serrated surface for securing the plunger switch inside the cavity.

10. The plunger switch of claim 1, wherein an end portion of the plunger does not contact the switch body when completely recessed within the switch body.

11. The plunger switch of claim 1, wherein the plunger includes an engaging portion, the engaging portion being able to engage the second contact element in a second direction, opposite the first direction, so that the second contact element and the plunger move together, the plunger being movable with respect to the second contact element when the engaging portion does not engage the second contact element.

12. The plunger switch of claim 11, wherein the engaging portion is a shoulder radially projecting from the plunger.

13. The plunger switch of claim 1, wherein the first contact element is a pair of parallel pins forming a plug.

14. The plunger switch of claim 1, wherein the second contact element is substantially annular.

15. The plunger switch of claim 1, wherein the second contact element and the plunger have radial projections, and the switch body has inner longitudinal grooves in which the radial projections can slidingly travel.

16. The plunger switch of claim 1, wherein the ridged surfaces are configured to perform oxidation cleanup.

17. A plunger switch comprising:

a switch body having a first base and a second base and defining a longitudinal axis with a first direction and a second direction, the first direction being from the second base to the first base, the second base having an opening, the switch body housing:

a first contact element partially housed in the switch body and extending out for operative communication with a circuit, the first contact element immovable about the switch body and including a first contact portion;

a second contact element being movable along the axis and aligned to contact the first contact element through movement, the second contact element including a second contact portion;

an elongate plunger including an engaging portion, the plunger being movable out of the opening along the axis, the engaging portion being able to engage the second contact element in the second direction so that the second contact element and the plunger move together, the plunger being movable in the first direction with respect to the second contact element when the engaging portion does not engage the second contact element;

a first biasing element configured to bias the plunger in the second direction; and a second biasing element configured to bias the second contact element in the first direction, wherein the first and second contact elements do not contact in a default first operative position, the first and second contact elements contact in a second operative position, and movement of the plunger in the first direction allows the second operative position to be reached, and wherein the first and second contact portions have ridged surfaces that are aligned so as to not mate.

18. A plunger switch comprising:

a switch body having a first base and a second base and defining a longitudinal axis with a first direction and a second direction, the first direction being from the second base to the first base, the second base having an opening, the switch body housing:

a first contact element partially housed in the switch body and extending out for operative communication with a circuit, the first contact element immovable about the switch body and including a first contact portion;

a second contact element being movable along the axis and aligned to contact the first contact portion through movement, the second contact element including a second contact portion;

an elongate plunger including an engaging portion, the plunger being movable out of the opening along the axis, the engaging portion being able to engage the second contact element in the second direction so that the second contact element and the plunger move together, the plunger being movable in the first direction with respect to the second contact element when the engaging portion does not engage the second contact element;

a first biasing element configured to bias the plunger in the second direction;

a second biasing element configured to bias the second contact element in the first direction;

wherein the first and second contact elements do not contact in a default first operative position, the first and second contact elements contact in a second operative position, and movement of the plunger in the first direction allows the second operative position to be reached, and wherein the first and second contact portions include silver nitride.

19. A plunger switch comprising:

a switch body having a first base and a second base and defining a longitudinal axis with a first direction and a second direction, the first direction being from the second base to the first base, the second base having an opening, the switch body housing:

a first contact element partially housed in the switch body and extending out for operative communication with a circuit, the first contact element immovable about the switch body;

a second contact element partially housed in the switch body and extending out for operative communication with the circuit, the second contact element immovable about the switch body;

a third contact element being movable along the axis and aligned to contact the first contact element through movement;

a fourth contact element being movable along the axis and aligned to contact the second contact element through movement;

an elongate plunger including an engaging portion, the plunger being movable out of the opening along the axis and able to be completely recessed in the switch body, the engaging portion able to engage the third contact element in the second direction so that the third contact element and the plunger move together, the plunger being movable in the first direction with respect to the third contact element when the engaging portion does not engage the third contact element, the plunger moving with the fourth contact element in the both directions;

a first biasing element configured to bias the plunger and the fourth contact element in the second direction;

a second biasing element configured to bias the third contact element in the first direction;

wherein the second and fourth contact elements contact in a default first operative position, the first and third contact elements contact in a second operative position, and movement of the plunger in the first direction allows the second operative position to be reached.

20. The plunger switch of claim 19, wherein the contact elements contact at contact portions, and at least a pair of the contact portions has ridged surfaces that are oriented so as to have intersecting points at contact.

21. The plunger switch of claim 19, wherein the contact elements contact at contact portions, and at least a pair of the contact portions includes silver nitride.

22. The plunger switch of claim 19, wherein the engaging portion is located on the plunger so as to keep the third and fourth contact elements a minimum distance apart making the first and second operative positions asynchronous.

* * * * *